US005158397A

United States Patent [19]

Koos et al.

[11] Patent Number: 5,158,397

[45] Date of Patent: Oct. 27, 1992

[54] PASSIVE FIRE PROTECTIVE SYSTEMS FOR ARTICULATING JOINTS AND FLEXIBLE CONNECTIONS

[75] Inventors: John D. Koos, Orange, Calif.; Alan E. Ester, Tomball, Tex.

[73] Assignee: Paul-Munroe Hydraulics, Inc, Orange, Calif.

[21] Appl. No.: 695,296

[22] Filed: May 3, 1991

[51] Int. Cl.[5] ..... E21B 43/01

[52] U.S. Cl. ..... 405/195.1; 166/364; 166/367; 405/224.4

[58] Field of Search ..... 405/63, 71, 157, 169, 405/195, 202, 211, 216, 195.1, 224.4; 166/350, 359, 364, 367

[56] References Cited

U.S. PATENT DOCUMENTS

| | | | |
|---|---|---|---|
| 4,619,553 | 10/1986 | Fischer | 405/63 |
| 4,770,563 | 9/1988 | Pido | 405/169 |
| 4,883,387 | 11/1989 | Myers et al. | 405/195 |
| 4,923,332 | 5/1990 | Sanocki et al. | 405/63 |

*Primary Examiner*—David H. Corbin
*Attorney, Agent, or Firm*—Joseph R. Dwyer

[57] ABSTRACT

A passive fire protection system for the protection of articulating joints and flexible connections against flame and heat in a severe total environment type fire such as a hydrocarbon fire which includes multi-layered flexible protective covers on articulating joints and flexible connections. These multi-layered flexible covers comprise an outer section of one or more layers of cloths, the outer section being of an abrasion resistant, weatherproof outer layer, with a woven ceramic fiber to resist flame impingement, and reinforcement mesh and stitching as required. The inner section is a thick interior multi-layered composite blanket of ceramic fibrous materials, barrier films, and an inner layer of abrasion resistant cloth to minimize heat transfer to the articulating joint or flexible connection. The thickness of the interior layer is determined by the mass being protected and the height of the allowable temperature for a particular fire rating. The multi-layered fire protective cover may comprise elongated tube-like covers as well as end caps depending on the structure being protected. Also disclosed is a method of providing a passive fire protective system for articulating joints and flexible connections. The invention is disclosed in connection with a offshore marine riser tensioner system but also may be used wherever fire protection is needed.

18 Claims, 5 Drawing Sheets

PASSIVE FIRE PROTECTIVE SYSTEMS FOR ARTICULATING JOINTS AND FLEXIBLE CONNECTIONS

BACKGROUND OF THE INVENTION

The purpose of this invention is to provide a passive fire protection system against flame and heat which is suitable for all environments, including an open ocean environment, and is specifically directed to the protection of articulating joints and flexible connections against flame and heat in a severe total environment type fire, viz, a hydrocarbon fire.

Prior to this invention, articulating joints and flexible connections in many systems were exposed (unprotected) and provided a weak link in the fire protection of such systems. For example, in a marine riser tensioner system of an offshore oil or gas rig, the tensioner cylinders and other rigid structural members were protected against fire and heat by the coating of an intumescent epoxy material, while the articulating joints and rods of the tensioner system were unprotected. This weak link was particularly dangerous in an offshore rig in that, during a fire, if one of the marine riser tensioners failed, it may slam into adjacent risers and create a domino affect causing the failure of adjacent risers. This would provide an additional source of fuel for the fire.

It is therefore a primary object of this invention to provide a system with flexible passive fire protection against heat and flame in a severe total environment type fire (i.e., hydrocarbon fire) by enabling articulating joints and flexible connections to maintain their structural integrity for various durations of fire exposure.

Still another object of this invention is to provide a sealing mechanism between the flexible fire protection system which protects articulating joints and flexible connections and the rigid fire protection system which protects the rigid structural members of a marine riser system.

SUMMARY OF THE INVENTION

To accomplish the foregoing objects, articulating joints and flexible connections are covered with a multi-layered flexible protective cover which comprises an outer section of multiple layers of cloth, the outer layers being of an abrasion resistant, weather resistant material, and at least one of these layers being a woven ceramic fiber that helps to eliminate flame impingement, one or more layers of reinforcement (as may be required), and an inner section composed of a thick interior multi-layered composite blanket of ceramic fibrous materials and barrier films and an inner abrasion resistant lining to minimize heat transfer and gas passage to the articulating joint or flexible connection. The outer section of the cover facilitates handling of the protective cover. In a riser tensioner system, the multi-layered flexible protective cover is used to cover articulating joints and is sealingly connected to the tensioner cylinder rigid structural members which are protected by an intumescent epoxy. In those riser tensioner systems having emergency supporting mechanisms, such as chain, rope, or struts, said support member is protected by a tubular shaped, multi-layered, flexible protective cover with the ends capped by a multi-layered flexible protective cover in the form of a bag. All multi-layered flexible protective covers are held together by straps of the same materials as the outer section layers. The thickness of the interior blanket of composite fibrous material, barrier films, and liner determines the duration of the protection against heat and flame. For additional protection, in those parts of the structural members where the intumescent epoxy ends, a ceramic fiber and binder compound is deposited as by caulking before the protective covers are placed over the uncovered parts of the structural members and over a portion of the epoxy. This compound expands in the presence of heat and flame to prevent intrusion of heat and flame beneath the protective covers.

This invention also includes a multi-layered flexible protective cover in accordian pleated form to fire protect the rods of the pneumatic-hydraulic riser tensioners which heretofore had been exposed. Also, the tensioner ring connecting the rods to the risers are also covered with a multi-layered flexible protective cover in accordance with this invention.

It will be apparent to those skilled in the art after having studied the drawings and having read the Detailed Description hereinafter, that while all articulating joints and flexible connections of a riser tensioner system described and shown herein have been covered with a fire protective cover, it should be clear that some rig operators will not want all of the riser tensioner system fully protected for whatever reason and thus protective covers may be left off some of the articulating joints and flexible connections. In some instances, too, the flexible connections may be eliminated entirely.

DETAILED DESCRIPTION

Figure 1:
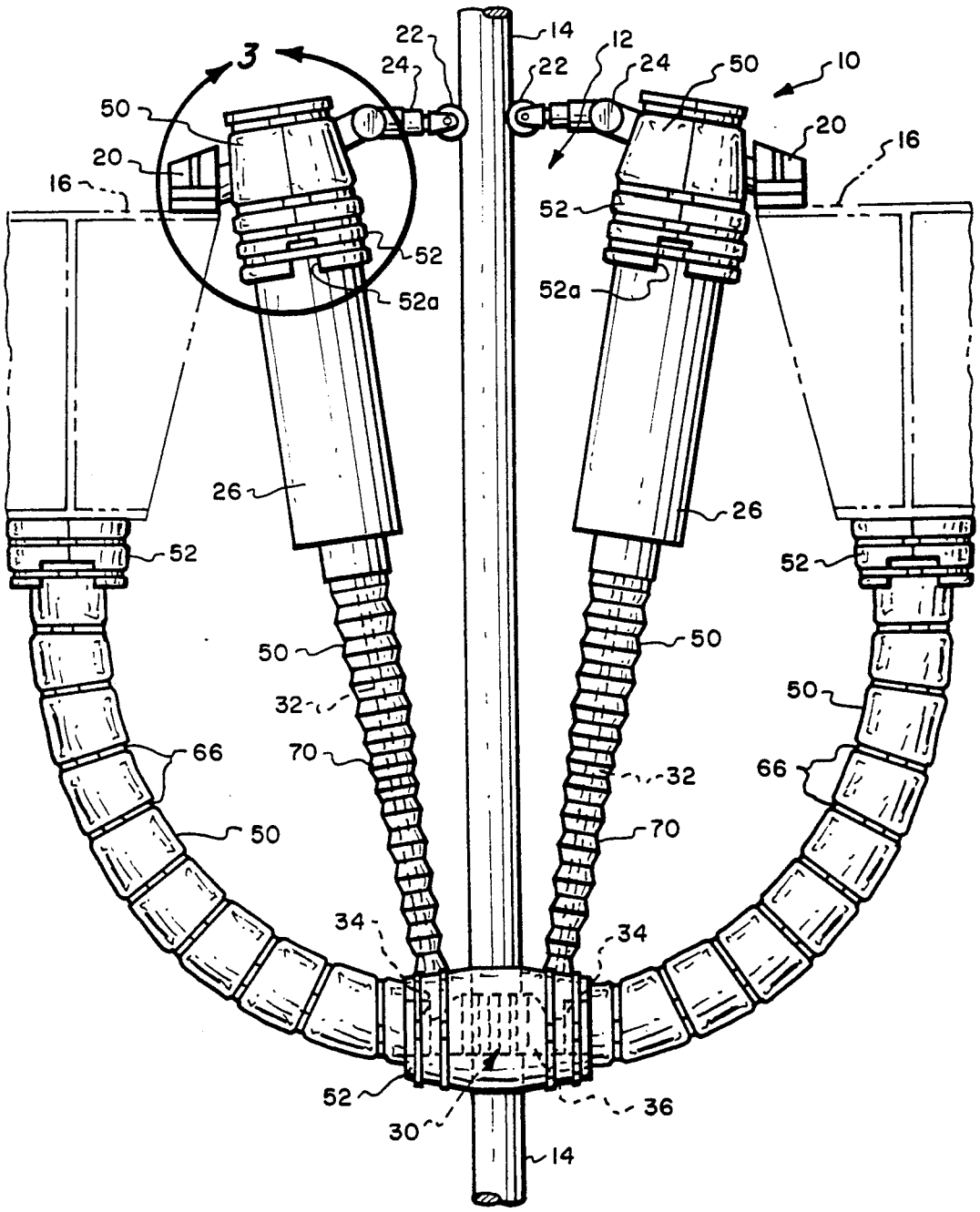
FIG. 1 is an elevational view of a riser tensioner system on an offshore rig illustrating the fire protection of the articulating joints and flexible chain and tensioner rods in accordance with this invention.
Figure 2:
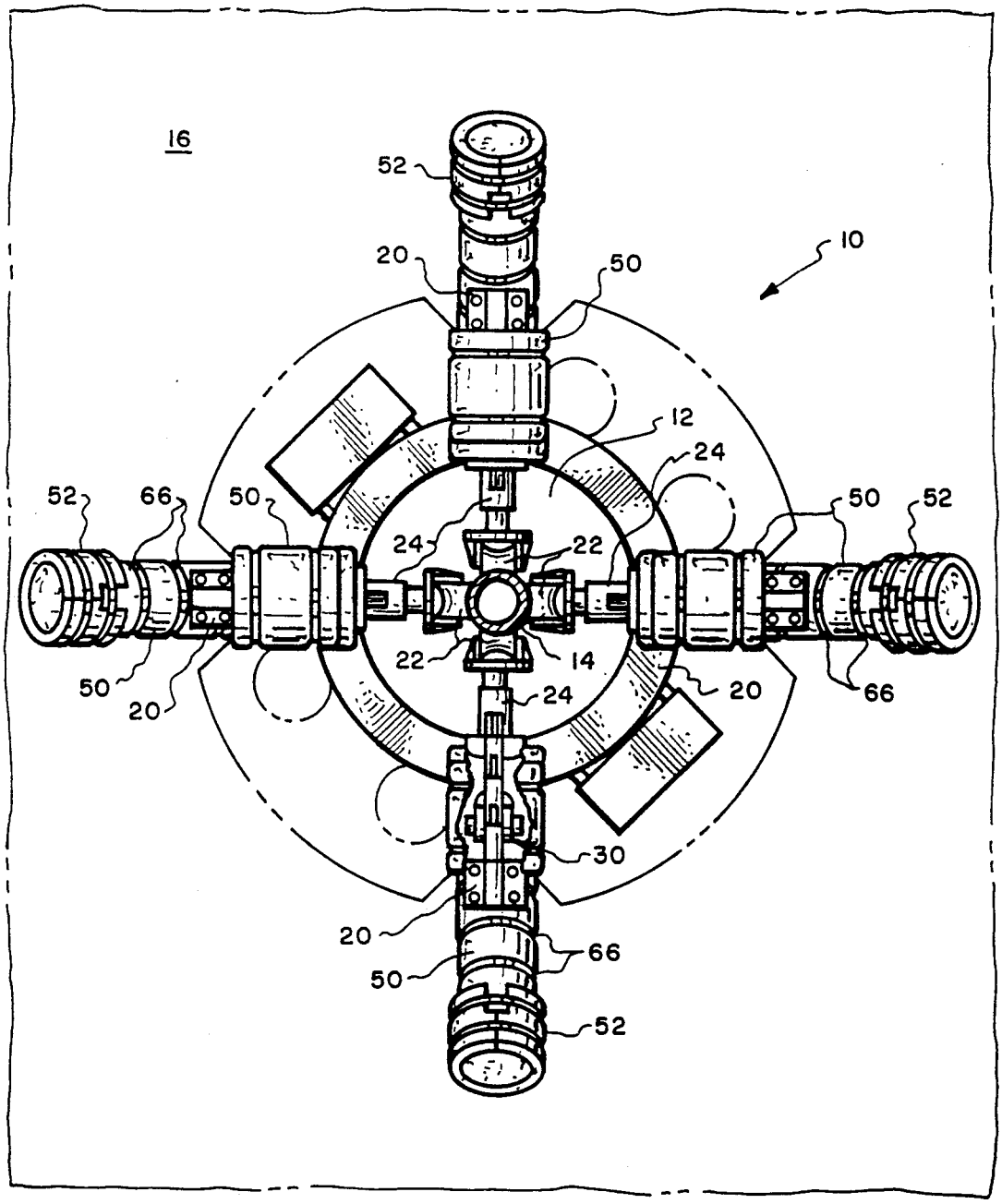
FIG. 2 is a top plan view of the riser tensioner system of FIG. 1 with one part exposed to show the articulated joints of the system.

FIGS. 1 and 2 show a conventional marine riser tensioner system having fire protection in accordance with the teachings of this invention.

FIGS. 1 and 2 illustrate the riser tensioner system 10 of the pneumatic-hydraulic type which extends through a hole 12 in a platform of an offshore rig to permit relative motion between a riser 14 and the platform. Riser 14 is the top section of a marine riser which extend from the platform to a well on the ocean floor. The riser tensioner system 10 is secured to a suitable support, such as the I-beams 16 and a supporting ring 20 which encircles the riser 14. Rollers 22 guide and center the riser 14. The supporting ring 20 is spaced above and secured to the I-beam 16 by short structural members 24 to provide sufficient clearance for pneumatic-hydraulic tensioner cylinders 26 (only two shown in FIG. 1). As more clearly shown in FIGS. 3 and 4, these cylinders 26 are connected to the structural members 24 by articulating joints 30 formed by pins 30*a*, eye-bolts 30*b* and clevises 30*c*. Typically, the tensioner cylinders 26 are connected to the support means 16 and extend downwardly where their rods 32 are connected to the riser 14 by articulating joints 34 typically formed by clevises and slots formed in a tensioner ring 36 secured to the riser 14. FIG. 8*c* schematically shows such an articulated joint 34 and the up and down movement of the rod 32. Thus, during relative movement between the riser 14 and the platform as a result of wave motion, the riser 14 is continually under tension as a function of the pneumatic-hydraulic cylinders 26. Some riser tensioner systems, such as 10, have additional protection in the form of chains 40, shown covered in FIG. 1 and shown exposed in FIGS. 5–7, which provide a flexible connection securing the riser tensioning ring 36 to the I-beams 16. Articulated joints 42 are formed by suitable eyebolts 42*a*, pins 42*b* and clevises 42*c* at each end of the chain.

Thus far described, the riser tensioner system is conventional and shown in any number of patents and articles about offshore subsea drilling and production rigs and need not be described further.

As mentioned before, the riser tensioner system 10 was partially fire protected by a coating of intumescent epoxy on the tensioner cylinders 26 and other rigid members, such as the supporting ring 20 and structural members 24, but the articulating joints, such as 30 (FIGS. 1, 3 and 4),34 (FIGS. 1 and 8*c*) and 42 (FIGS. 5–7), as well as the cylinder rods 32 (FIG. 1) were exposed and vulnerable to heat and flame. This invention, on the other hand, provides these exposed and vunerable parts by enabling the articulating joints, flexible connections and cylinder rods to maintain their structural integrity for a selected duration of fire exposure.

Figure 5:
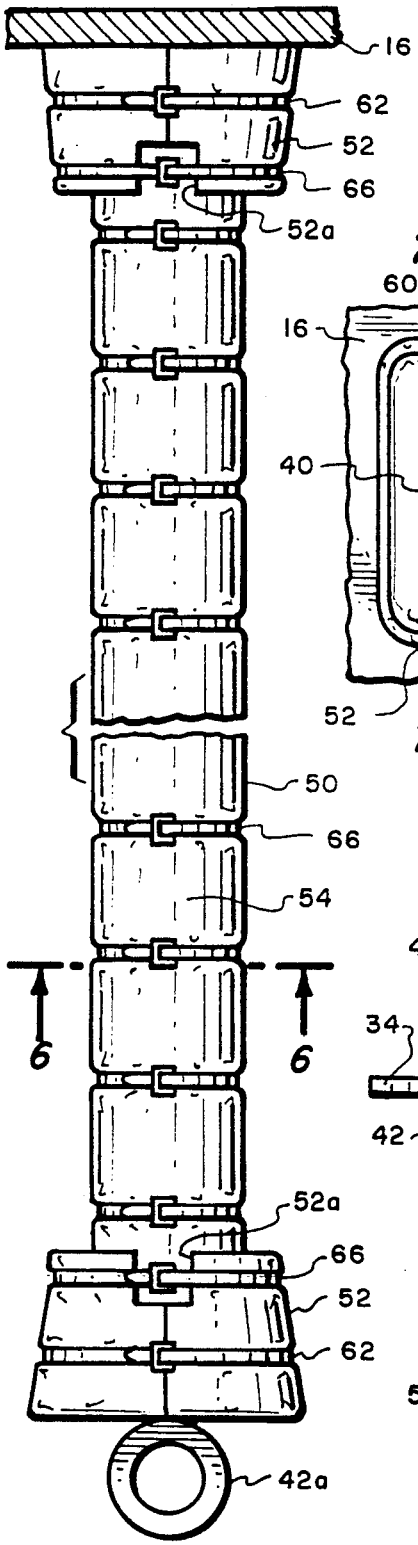
FIG. 5 is a elevational view of one of the chains of FIG. 1 showing the elongated cover and protective end covers or bags of multi-layered protective material.
Figure 6:
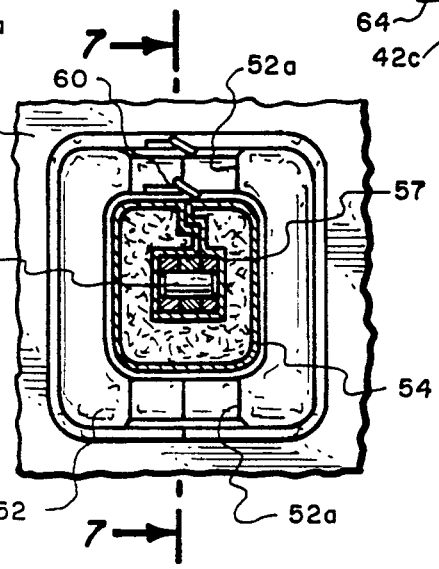
FIG. 6 is a cross-sectional view showing the chain and its protective cover, taken along line 6—6 of FIG. 5.
Figure 7:
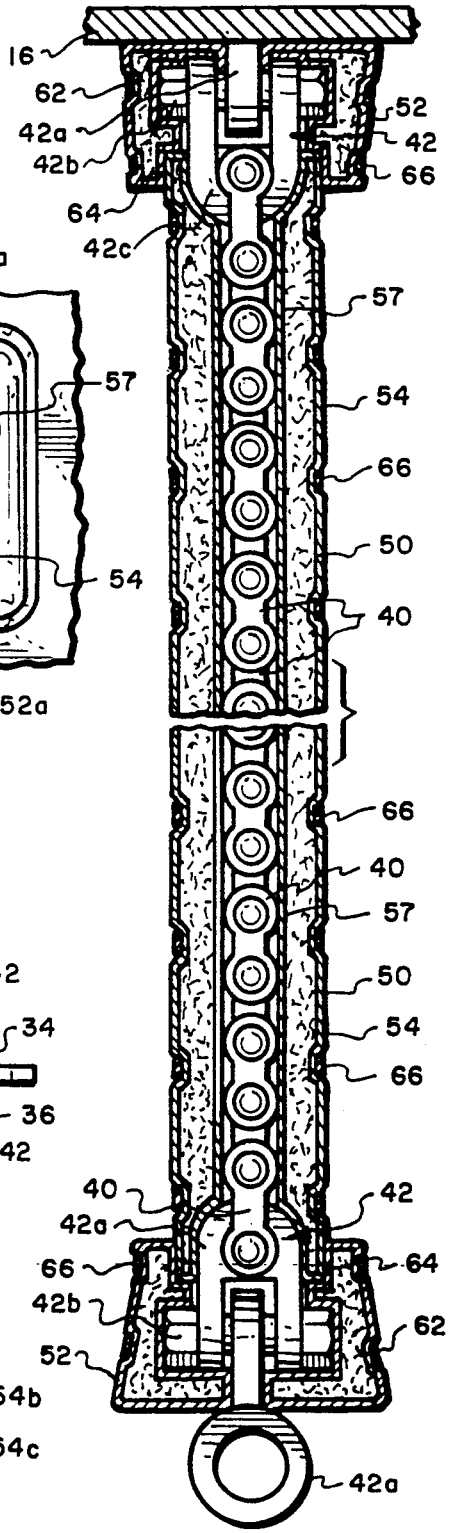
FIG. 7 is a view like FIG. 5 showing the chain and its protective cover, in cross section, taken along line 7—7 of FIG. 6, FIGS. 8*a*–8*d* show various articulating joints with protective covers in accordance with this invention.
Figure 8A:
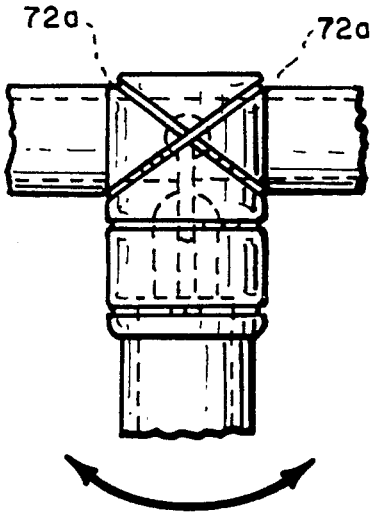
Figure 8B:
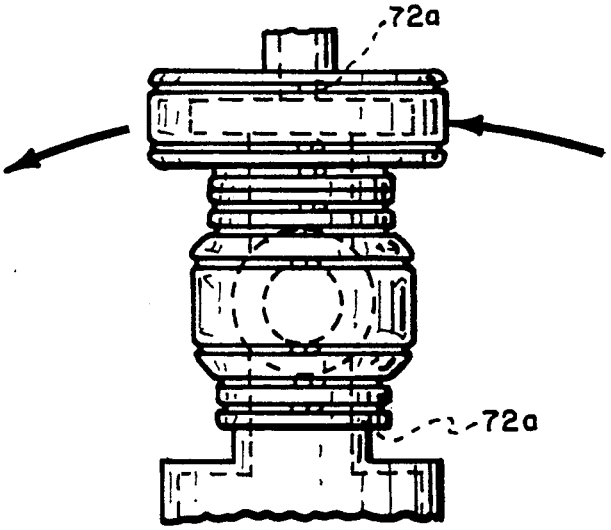
Figure 8C:
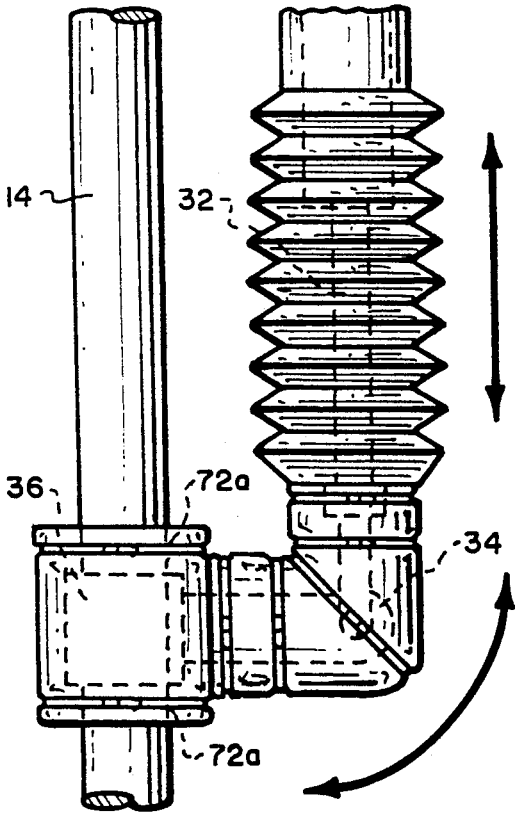
Figure 8D:
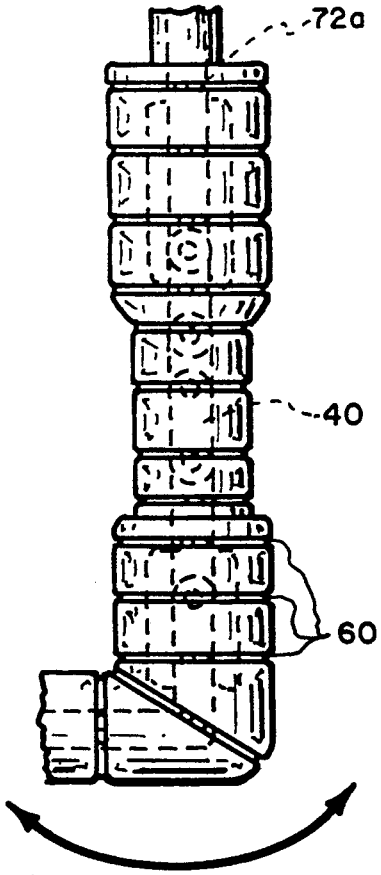

Thus, FIGS. 1 and 2 show all articulating joints and flexible connections covered with a multi-layered flexible cover 50 more clearly shown in FIGS. 5–7. In these latter figures, the flexible multi-layered cover 50 is shown covering the flexible connection (chain 40) and articulated joints 42. These figures exemplify the fire protection of the articulated joints 30, 34 and 42 of the tensioner cylinders 26 in that the articulated joints 42 at both ends of the chain 40 are shown covered with protective end caps 52. Such end caps are also used to cover the articulating joints 30 and 34.

Figure 10:
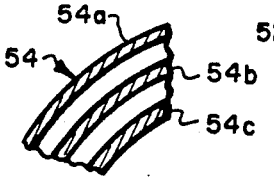
FIG. 10 shows part of a multi-layered covering for the protective covers.

Thus, as seen in FIGS. 5–7, the multi-layered flexible protective cover 50 comprises an outer section 54, a thick interior section 56 of multi-layered composite ceramic fibrous materials, barrier films, an inner abrasion resistant liner 57 to minimize heat transfer and gas passage. In the embodiment shown, the outer section 54 completely encloses the interior section 56. A portion of the outer section of one or more layers of cloth connected to the outer section 64 may be used adjacent the articulating joints or flexible connections to facilitate handling. The outer section 54 is shown as a single layer in the drawings but this outer section is multi-layered as shown in FIG. 10 at 54*a*,54*b*, and 54*c*. As shown in FIGS. 5–7, the protective cover 50 is rolled into the form of a tube, substantially equal in length to the length of the structural member, shown as chain 40 with the longitudinal ends overlapped and stepped as at 60 to prevent heat and flame intrusion. The ends of the tube have the end caps 52 made of the same layers of material. These end caps 52 cover the articulating joints 42 and overlap the ends of the protective cover 50 as at 62 to prevent heat and flame intrusion. These caps 52 also form a sealing mechanism between the articulating joints and the rigid structural members as at 64. While the protective cover 50 is shown formed by rolling a flat protective cover around the chain and overlapping the longitudinal ends as at 60 to prevent heat and flame entrance, the protective cover 50 may also be formed as an integral tube and slipped over the chain 40 before connecting the articulating joints 42 to the chain. Suitable straps 66 made of the same material as the outer cover 54 secure the end caps 52 and cover 50 and the end caps are preferably provided with cutaway portions 52*a* to allow the straps 66 to bind the end caps 52 to the outer cover 50 or to the structural members or cylinders as the case may be.

Returning to FIG. 1, it can be seen that the multi-layered protective cover 50 is pleated as at 70 and connected to each cylinder 26 and to the tensioner ring 36 by the same type of end cap 52 as that shown in FIGS. 5 and 7. The pleating of the protective covers 50 allows extension and retraction of the rods 32 within the cylinders 26 to maintain the riser under tension during relative movement between the platform and the riser 14.

Figure 3:
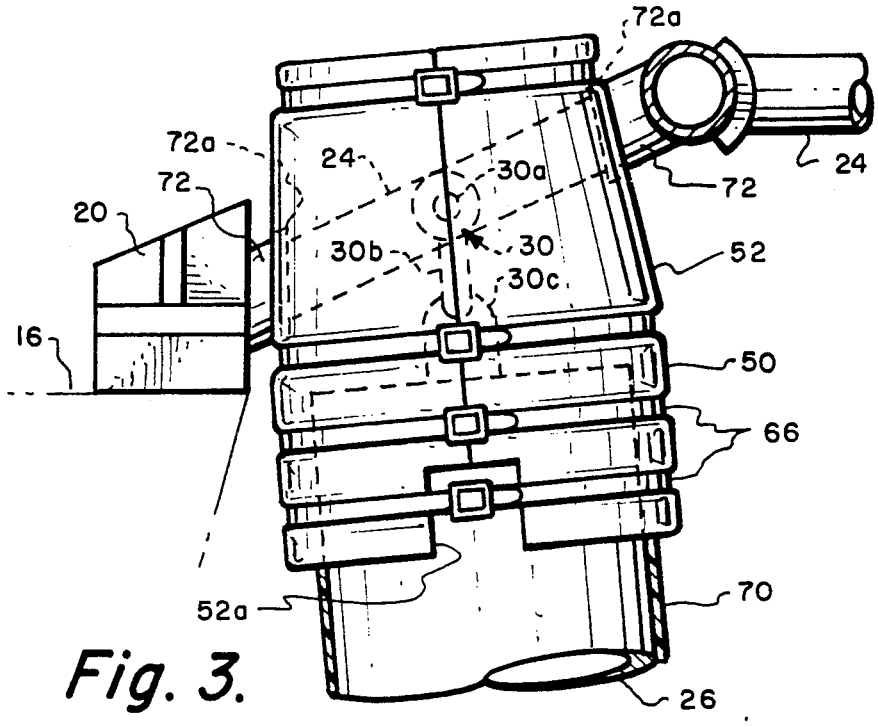
FIG. 3 is an enlarged view of a protective cover over an articulating joint and part of structural members in the area encircled in FIG. 1.
Figure 4:
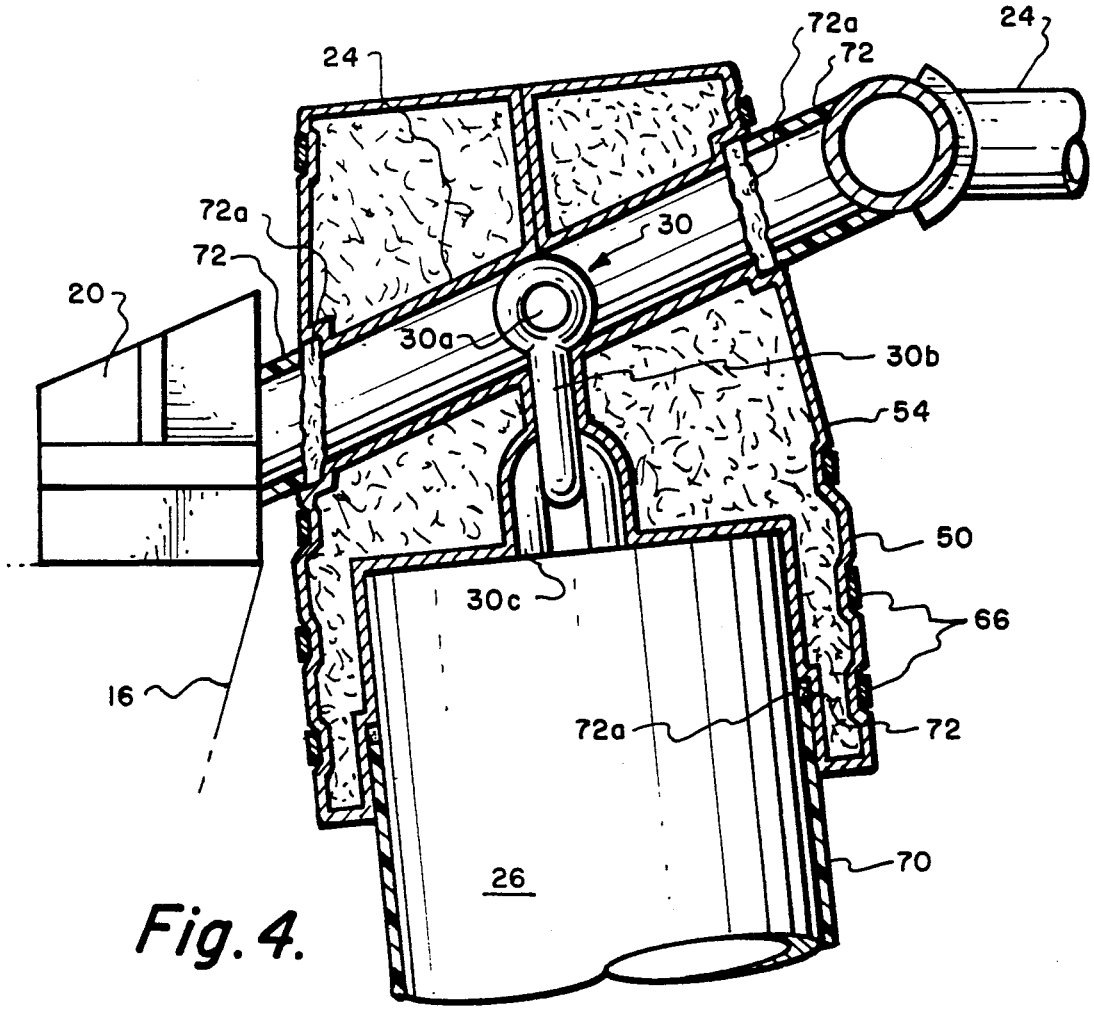
FIG. 4 is a view similar to FIG. 1 but broken away to show the internal parts thereof.

FIGS. 3 and 4 show the end cap 52 covering the articulated joint 30 and a portion of the cylinder 26. Again, suitable straps 66 secure the end cap 52 around the articulated joint and over the cylinder 26 As shown in FIG. 4, the structural member 24 is coated with an intumescent epoxy 70 over most of the cylinder 26. For further protection against heat and flame entrance at those places where the epoxy 70 ends and the protective covering overlap, a ceramic heat resistant compound 72 is disposed as by caulking. This compound, when subjected to heat and flame, aids in the prevention of heat and flame beneath the protective covers for the protection of the structural members. This caulking compound is placed at any point in the system where the intumescent epoxy ends leaving the metal parts exposed, for example, at points 72*a* in FIGS. 1 and 8*a*–8*d*.

It should be apparent from the foregoing that the protective cover 50 and end caps 62 may be formed in any suitable manner to cover the articulating joints and the flexible connections as well as any exposed structural member subjected to possible damage by heat and flame.

FIGS. 8*a*–8*d* show different movements of articulating joints and other means of connecting various parts to one another whose movement is represented by the arrows. In these figures, the protective covers 50 are also in the form of tubes with end caps, such as shown in FIGS. 5–7.

Figure 9:
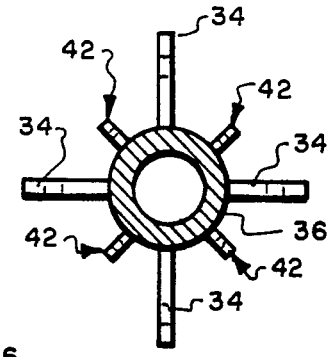
FIG. 9 is a schematic cross-sectional view of a tensioner ring to show more clearly than in FIGS. 8*c*–8*d* where and how the pneumatic-hydraulic cylinders and flexible connections are connected thereto.

FIG. 9 shows a top view of one type of tensioner ring 36 showing the means for connecting the tensioner cylinder rods 32 to the tensioner ring as at 34 and the means for connecting the chain mechanisms 40 to the tensioner ring as at 42.

For a particular fire rating, the mass being protected, the height of the allowable temperature and the thickness of the insulation, are considered. For example, a solid steel pipe which takes a long time to heat up and which is rated for four hours probably needs about three inches of insulation to be provided by the protective cover 50. A round pipe with a hollow core may require still more protective covering and a thicker protective cover blanket. Thus, the insulation provided by the protective cover 50 can be adjusted according to the needs of the item being protected.

Finally again, while FIGS. 1–8*d* show a single layer outer section 54 including liner 57, such section is made of more than one layer as illustrated at 54*a*,54*b* and 54*c*.

We claim:

1. A passive fire protection system for protecting apparatus which has rigid structural members and at least one articulating joint against flame and heat comprising, a multi-layered flexible protective cover positioned over said articulating joint which comprises, an outer cover means to protect said cover against abrasion and weather, to provide reinforcement, and to help eliminate flame impingement, and a thick interior blanket of ceramic fibrous material, barrier films, and an inner abrasion resistant liner, to minimize heat transfer to the articulating joint.

2. The protection system as claimed in claim 1 wherein said protective cover conforms to the configuration of said articulating joint and is formed to overlap part of said rigid structural members.

3. The protection system as claimed in claim 2 wherein said structural members are protected by an intumescent epoxy and wherein said protective cover overlaps said epoxy.

4. The protection system as claimed in claim 3 wherein a ceramic compound is deposited between said epoxy and said protective cover to prevent heat and flame intrusion beneath said protective cover.

5. The protection system as claimed in claim 4 in which said apparatus further includes flexible connections between said structural members and wherein said protective cover is disposed over said flexible connections and over any articulating joint connected to said flexible connections.

6. The protection system as claimed in claim 5 wherein said protective cover is in the form of a tube for surrounding flexible connections and in the form of protective caps overlapping the ends of said flexible connections and covering any articulating joints connected thereto.

7. The protection system as claimed in claim 6 further including flexible straps of outer cover materials to hold the protective cover together and to bind said cover to said protected structure.

8. In a riser tensioner system, including a plurality of pneumatic-hydraulic type cylinders and cylinder rods which extend from an offshore rig to a riser to maintain the riser in tension during vertical movement of the rig and which are connected to said rig and to said riser by a plurality of articulating joints, the improvement in such system comprising, multi-layered flexible protective cover means disposed over said articulating joints for the protection of said articulating joints against heat and flame.

9. The tensioner system as claimed in claim 8 further including multi-layered protective covers of accordian pleated form connected between said cylinders and over the length of said cylinder rods to protect the cylinder rods against heat and flame.

10. The tensioner system as claimed in claim 9 wherein said structural members and said cylinders are covered with a intumescent epoxy and wherein said protective covers overlap said intumescent epoxy.

11. The tensioner system as claimed in claim 10 wherein a ceramic compound is deposited between said intumescent epoxy and said protective cover to prevent intrusion of heat and flame beneath said protective cover.

12. The tensioner system as claimed in claim 11 further including flexible connections between said rig and said riser and protective covers over said flexible connections and any articulating joint connected thereto.

13. The tensioner system as claimed in claim 12 wherein said flexible cover over said flexible connections is in the form of a tube with end caps overlapping the ends of said tubes and covering said articulating joints connected thereto.

14. The tensioner system as claimed in claim 13 further including any number of straps of multiple layers of abrasion resistant, weather protective cloth, ceramic fiber cloth, and reinforcement mesh or stitching to hold said protective cover together and to bind said protective cover to the structure being protected.

15. The tensioner system as claimed in claim 14 further including a spider connected to said riser and forming with said cylinder rods articulating joints to connect the ends of said cylinder rods to said riser and said multi-layered flexible protective cover means formed over said spider and said articulating joints.

16. A method of providing protection of articulating joints or flexible connections between rigid structural members in a riser tensioner system which includes a plurality of pneumatic-hydraulic type cylinders and cylinder rods comprising the steps of, forming a multi-layered protective cover means with an interior blanket of ceramic fibrous material of a thickness determined by the temperature and duration of fire to be prevented from being transferred, and covering any flexible connection between said structural members with said multi-layered protective cover and covering any articulating joint with said protective cover.

17. The tensioner system as claimed in claim 16 wherein said protective cover is formed according to the configuration of the structure being protected.

18. The tensioner system as claimed in claim 17 further including the provision of multi-layered protective covers of accordian pleated form connected between said cylinders and covering the length of said cylinder rods to protect the cylinder rods against heat and flame.

* * * * *